United States Patent [19]

Houle et al.

[11] 4,286,907

[45] Sep. 1, 1981

[54] GRID EXTENSIONS ON A ROTARY STACKER

[75] Inventors: Philip J. Houle, Smithfield, R.I.; Robert G. Oliver, South Dartmouth, Mass.

[73] Assignee: Gloucester Engineering Co., Inc., Gloucester, Mass.

[21] Appl. No.: 76,384

[22] Filed: Sep. 17, 1979

[51] Int. Cl.[3] ..... B65G 57/08; B65H 29/40

[52] U.S. Cl. ..... 414/72; 271/72; 271/83; 271/196; 414/27

[58] Field of Search ..... 414/27, 55, 56, 72, 414/81, 737; 198/404; 271/72, 66, 70, 82, 83, 196

[56] References Cited

U.S. PATENT DOCUMENTS

| | | | |
|---|---|---|---|
| Re. 27,523 | 11/1972 | Maccherone | 414/27 |
| 3,125,916 | 3/1964 | Hayes et al. | 271/83 X |
| 3,593,991 | 7/1971 | Baron et al. | 271/70 |
| 3,633,731 | 1/1972 | Jones | 271/83 X |
| 3,921,827 | 11/1975 | Joice | 414/27 X |

*Primary Examiner*—Leslie J. Paperner

*Attorney, Agent, or Firm*—Orrin M. Haugen; Thomas J. Nikolai

[57] ABSTRACT

A rotary stacker device for sequentially picking up and sequentially delivering plastic film products, onto mounting wickets. The rotary stacking device comprises a rotary hub upon which are mounted radially disposed work arms, with the arms having grid-like extension members for controllably positioning the film products during delivery and reducing air turbulence during the stacking process.

6 Claims, 4 Drawing Figures

GRID EXTENSIONS ON A ROTARY STACKER

BACKGROUND OF THE INVENTION

The present invention relates generally to an improved conveyor positioner system for flexible plastic film products, and particularly to a high speed wicketing or stacking device for handling flexible plastic film products as they are sequentially delivered in non-captive form from a web converting apparatus such as a flexible plastic film bag-making machine or the like. Bag-making machines for the fabrication of film products from polyethylene are examples of such apparatus, and are in common usage in the art.

A conveyor system to position the plastic film product, such as polyethylene bags, in correct alignment for the rotary stacking device is normally an inherent part of the bag-making apparatus. A conveyor system utilizing the Bernoulli effect to position the film product is described in co-pending application Ser. No. 909,000, filed May 24, 1978. The system disclosed in application Ser. No. 909,000 utilizes a flow of compressed gaseous fluid, such as air, beneath the plane of travel of the film product creating a pressure reduction that draws the film product to the stacker input station and positions the film product on a reliable and repeatable basis.

In certain stacking applications, a wicket pin is utilized for retention of a quantity of bags in a stack, with the bags normally having uniform perforations or holes along one of the ends, such as along an upper lip extension, for engagement with the wicket pin. Stacker apparatus which has been used in the past is disclosed in U.S. Pat. No. Re. 27,523 and U.S. Pat. No. 3,921,827, with such stacking apparatus employing a rotary hub carrying bag retaining arms for receiving the individual bags at a stacker input station for ultimate delivery onto a wicket member. As suggested in U.S. Pat. No. 3,921,827, the retaining arms of the stacker or wicketer device are provided with vacuum means for engaging the bag to be placed on a wicket member with means provided to terminate the vacuum at a given angular point in the rotary motion of the retaining arms to facilitate placement of the bag on the wicket member.

As can be appreciated, the problems encountered with handling plastic film products such as bags increases significantly as machine speed is increased. Plastic film products are exceedingly difficult to handle at high rates of speed because of the inherent flimsiness of the film material and the inherent viscosity of the ambient air. The film products become distorted and may fold or flex so that uniform pick-up and later delivery to the ultimate disposition may be adversely affected. In other words, any misalignment, folding or other anomalies in the form of the product will be reflected in adverse stacking conditions and may result in a jamming situation, damaged product, or an unattractive arrangement of finished product.

In order to assist in the correct alignment of plastic film products for placement on wicket members, to provide for adaptation of rotary stacking devices to accommodate large film products, to provide for less turbulence in the air in the production area, and to create a more energy efficient rotary stacking device, it has been found that the addition of grid-like extension members to one of the pair of work arms of a rotary stacking device is desirable.

Heretofore, rotary stacking devices have utilized either clamping means or vacuum pressure to hold a plastic film product in position on the arms of the stacker during the stacking or wicketing operation. The known stacking devices are limited as to the size of the plastic film product that may be utilized by these devices. The bag or other such product must fit within the pairs of clamps of a clamp-type system for proper operation. In a vacuum system, the distance between the arms, and therefore the size product that may be accommodated, is limited by the foil effect created by the movement of the plastic film through air. Too great a distance between the arms results in deformation of the film product between the arms during movement, and too small a separation results in overhang of the product on one of the arms with deformation or off-centering of the product occurring during movement.

It will be appreciated that conveyor and positioning systems, such as those described in pending Application Ser. No. 909,000, and vacuum pick-up systems, such as those described in U.S. Pat. No. 3,921,827, that are dependent on moving streams of air to create pressure differentials are susceptible to extraneous changes in air pressure caused by movement in close proximity to the work station. It will also be appreciated that changes in air pressure in proximity to the film products will cause off-centering or deformity of the film products themselves. These changes in air pressure and turbulence are created by the highspeed orbital movement of the arms of a rotary stacking device containing clamps or pads that present a large surface area against movement through the air of the loading and unloading zone.

The utilization of a grid-like extension member on one of the two arms of a rotary stacking device permits the use of the apparatus with varied sizes of film products without extensive modification of the apparatus or stacking system. The original spacing of the arms is retained thus reducing the foil effect of the moving film product and, by providing a support system for oversize products, distortions or off-centering caused by overhang of the film product from the arms is prevented and added stabilization for the film product is provided. The use of a grid-like extension member also serves to reduce air turbulence in the work area caused by rapid orbital movement of clamps or platens affixed to stacker arms.

SUMMARY OF THE INVENTION

Therefore, it is a primary object of the present invention to provide an improved means for sequentially moving flexible plastic film products from a base pad to a delivery point, the system including grid-like means for increasing the capability of rotary stacking devices to accommodate varying size film products.

It is a further object of the present invention to provide an improved means for increasing the capability of rotary stacking devices while causing a reduction in air turbulence in the work area by preventing changes in air pressure due to the rapid orbital movement of the arms of a rotary stacking device with planar sufaces perpendicular to the orbital plane of the stacker arms.

A further object of the present invention is to provide an improved means for increasing the capability of rotary stacking devices while more effectively stabilizing the plastic film product during delivery to a wicket member and increasing the reliability and repeatability of the stacking operation.

It is yet a further object of the present invention to provide a means for increasing the capability of rotary stacking devices with means provided for reducing the vacuum required in certain rotary stacker arms by increasing the stability of plastic film products during delivery to a wicket member and thereby reducing the energy expenditure necessary for reliable and repeatable delivery of the product to a wicket member.

Other and further objects of the present invention will become apparent to those skilled in the art upon a study of the following specification, appended claims, and accompanying drawings.

BRIEF DESCRIPTION OF THE DRAWINGS

FIG. 1 is a side elevational view of a system prepared in accordance with the present invention, and illustrating a rotary stacker arrangement having a base pad for receiving intermittently and sequentially delivered plastic film products at a receiving zone between opposed work arms carried on a rotary hub, and wicket members for receiving the plastic film products.

DESCRIPTION OF THE PREFERRED EMBODIMENT

Figure 2:
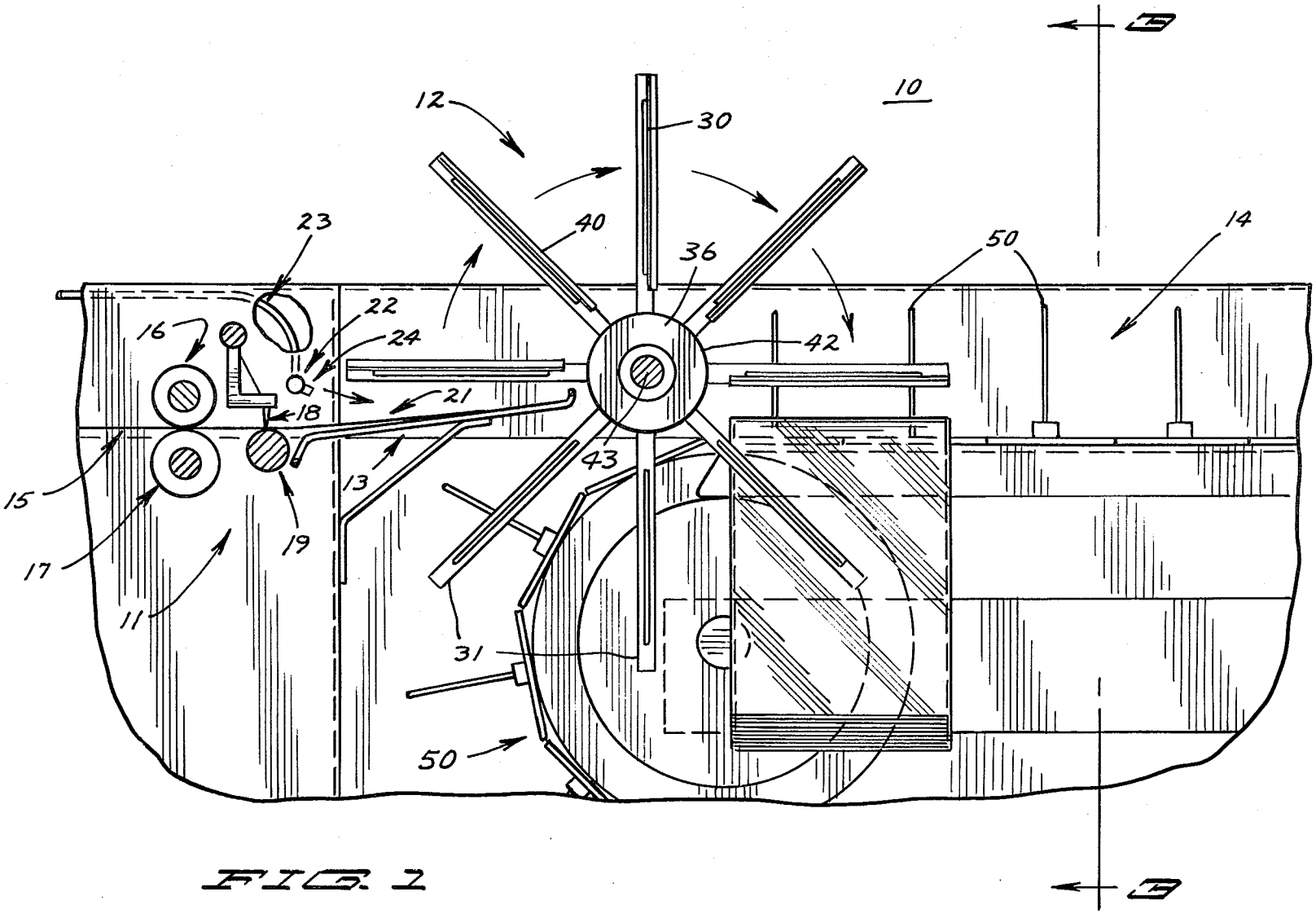
FIG. 2 is a top plan view of the structure illustrated in FIG. 1, and further illustrating the grid-like extension members of the opposing arms of the rotary stacker.
Figure 2:
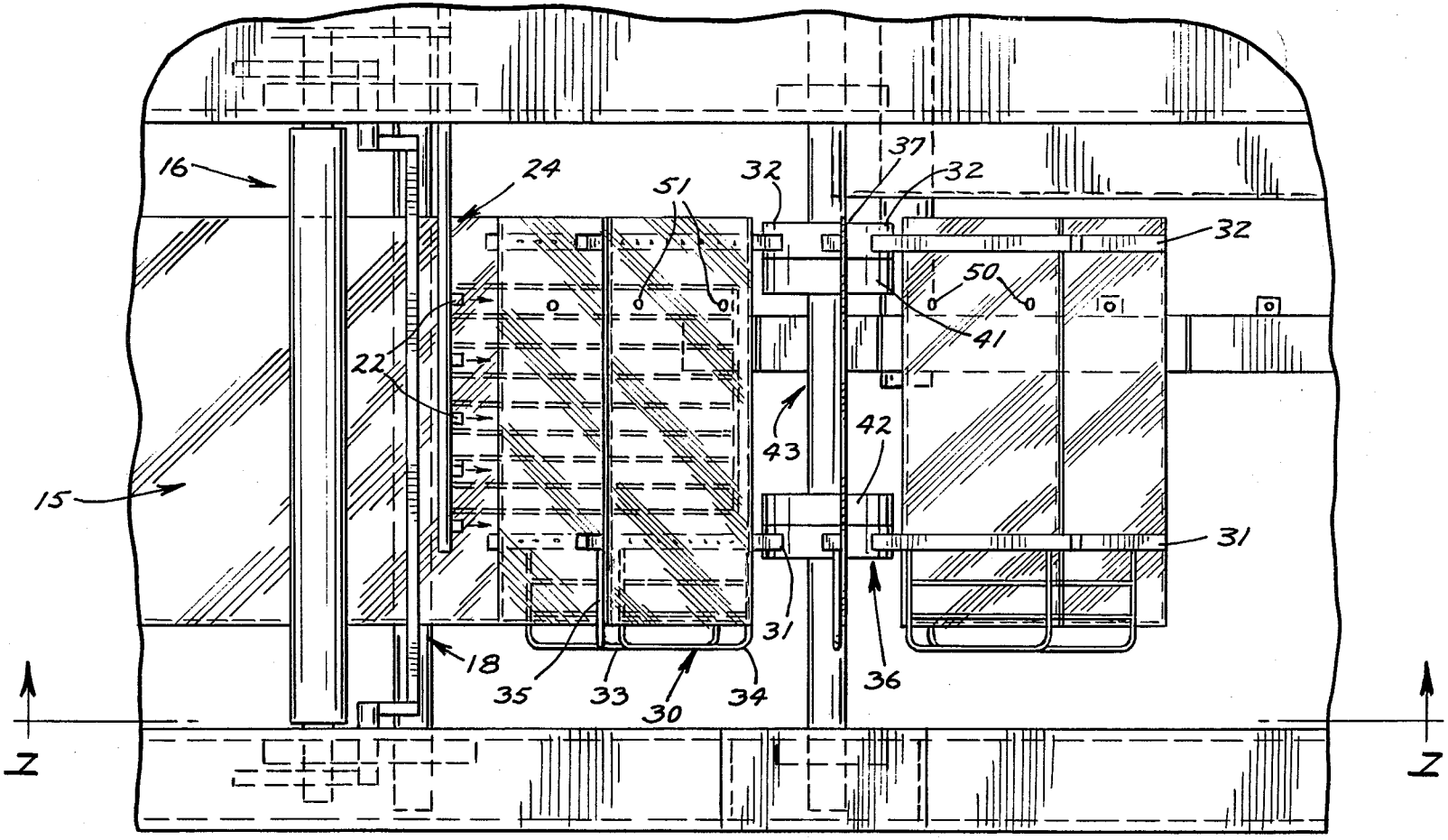
Figure 3:
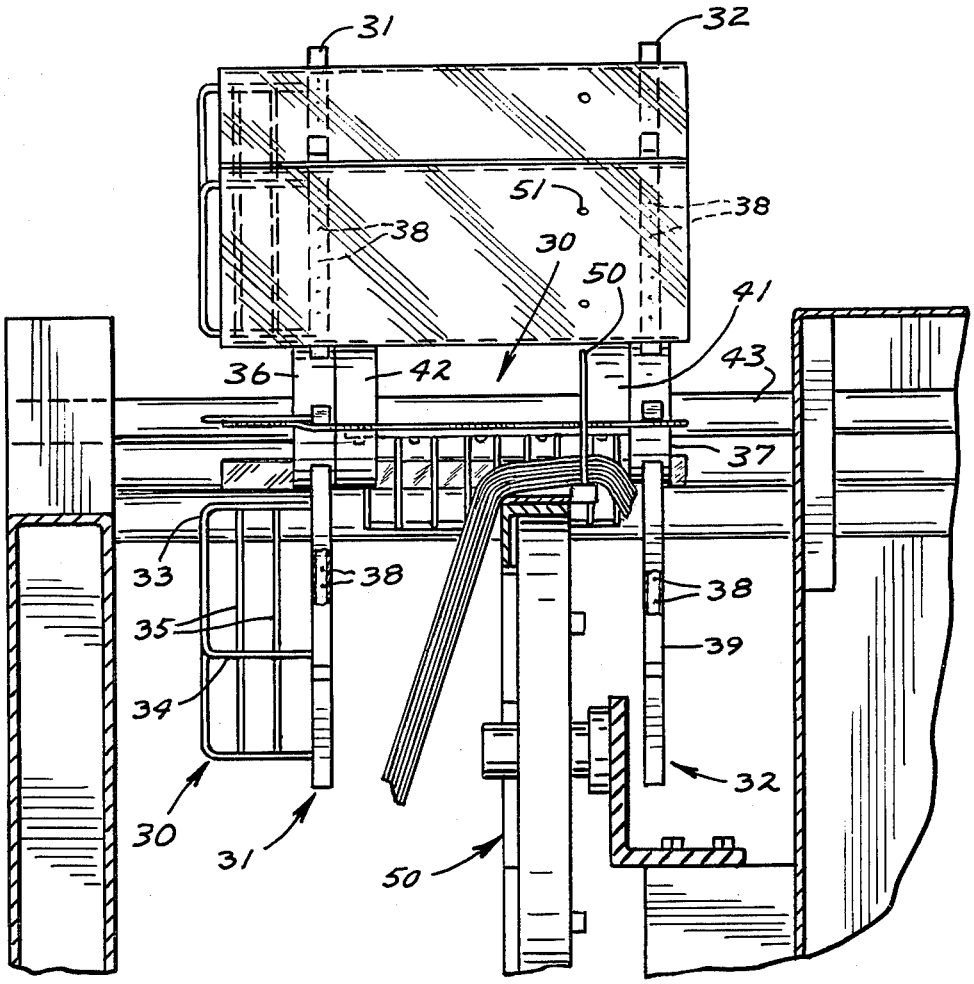
FIG. 3 is a rear elevational view of the structure illustrated in FIG. 1, as seen along the line 3—3 of FIG. 1.

With attention being directed to FIGS 1-3 of the drawings, it will be observed that the arrangement of FIG. 1 illustrates the three components of a flexible plastic film product converting system, with the system being generally designated 10 and including a bag-making apparatus generally designated 11 (with only a fragmentary portion including the draw rolls, hot knife and sealing roll portions being shown), a rotary stacker generally designated 12, along with an intermediate product delivery or stacker input station generally designated 13 and a wicketing device generally designated 14. Specifically, the bag-making apparatus as illustrated may be selected from any of the commercially available varieties, with one such structure being identified as a "Model 408" machine available from Sheldahl, Inc. of East Providence, R.I. Other commercially available bag-making machines may be employed, if desired, it being shown in the present system as a component of the overall system, and providing one example of a plastic film product delivering device.

Specifically, a web film 15 is driven by a pair of draw rolls such as an upper draw roll 16 and lower draw roll 17, for ultimate delivery to a sealing knife-sealing roll combination. A typical sealing knife is shown at 18, with an opposed rotatably mounted sealing roll 19. Plastic film in the form of web 15 is advanced through intermittent periods of draw and dwell by the draw rolls 16 and 17, with the sealing knife reciprocating upwardly and downwardly so as to make periodic contact with the sealing roll and thereby sever and seal the individual layers of film forming the web 15 to form a completed bag with each cycle.

As shown in FIG. 2, the rotary stacker 12 is of a type generally illustrated by the structure shown in U.S. Pat. No. 3,921,827, comprising shaft 43, hubs 36 and 37 and a plurality of pairs of arms 31—31 and 32—32 extending radially outwardly from hubs 36 and 37 with each of the said arms having a plurality of vacuum holes. It will be understood, of course, that any rotary stacking device utilizing radially positioned pairs of work arms and film retention devices that do not project above the planar surface defined by the work surfaces of the work arms, may be employed.

Referring to FIG. 3, arms 31—31 and 32—32 are provided with a plurality of holes 38 on the working face 39 of the arms. These holes extend in a single straight line substantially the entire length of the working face along the inside edge thereof. Arms 31 and 32 are hollow or may have a bore, and are connected, through socket means, with hubs 36 and 37 respectively. Hubs 36 and 37 are rotatably mounted on shaft 43 and are in working connection with manifolds 41 and 42 to provide the vacuum effect to holes 38.

FIGS. 2 and 3 illustrate the extension members 30 of arms 31. The extension members are mounted on the outside planar surface, which is perpendicular to the working face 39, of arms 31, with the working surface of the extension member being in the same plane as that extending across the working faces 39 of arms 31—31 and 32—32. The extension members are generally mounted on the arms of the rotary stacker device the furthest disposed from the wicketing holes 51 in the plastic film product. In some cases, it will be appreciated, extension members may be applied to both of a pair of arms of a rotary stacker device as in the case where large amounts of plastic film material will overhang from both arms.

The extension members 30 are generally grid-like appendages to permit a flow of air around and through them as the arm is moved through the stacking cycles. Each extension member 30 consists of a plurality of parallelly spaced rods or tubes 35 held rigidly in place by end rods or tubes 33 and 34. End rods or tubes 33 and 34 are, of course, fixedly attached to arms 31 by appropriate means such as clamps, threads or welds.

Figure 4:
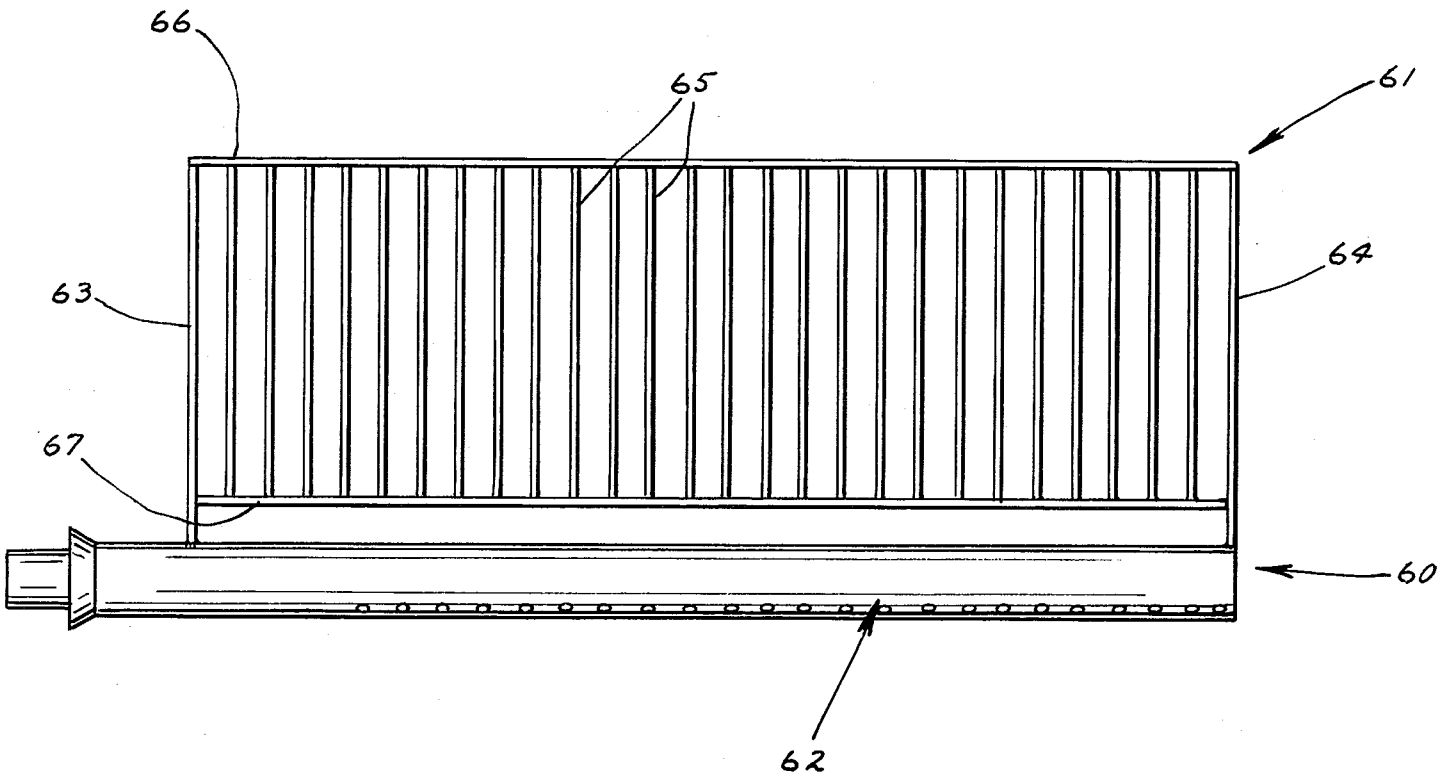
FIG. 4 is a top plan view of a work arm with a modified form of extension member for use in the present invention.

Attention is directed to FIG. 4 of the drawings wherein a modified form of the extension member is illustrated. In this arrangement, work arm 60 is equipped with an extension member 61. Extension member 61 is comprised of end support tubes or rods 63 and 64 that are fixedly attached, by appropriate means, to work arm 60 on the outwardly facing planar surface of work arm 60 perpendicular to the work face 62. A plurality of rods or tubes 65—65 are in parallel arrangement with end tubes or rods 63 and 64. Top and bottom braces 66 and 67, respectively, extend between end support rods 63 and 64 and rigidly hold rods 65—65 in place.

In certain applications, as described in co-pending Application Ser. No. 909,000, the film product pick-up station, such as at 21, may be ramped upwardly or tilted from the plane of travel of the rotary stacker work arms. In order to achieve a radial disposition which is generally parallel to the plane of the film product input station, the work arms may be arranged with a dog-leg design. In these instances the extension member should be attached near the distal end of the work arm above the elbow of the dog-leg.

As indicated, and disposed between the bag-making machine 11 and rotary stacker 12, is a film product receiver or stacker input station 13, with this product receiver including primarily a base pad 21 for receiving individual film products. This product receiver is fabricated in accordance with co-pending application Ser. No. 909,000, it being understood that other product receiving devices may be employed as well. Plastic film products may be positioned on base pad 21 through a plurality of spaced apart nozzles producing a Bernoulli effect pressure reduction by delivering a flow of a compressed gaseous fluid, such as air, along a plane generally beneath the plane of travel of the film product (not shown). An alternate or conjunctive positioning device may include a second air discharge system, as illustrated in FIGS. 1 and 2 at 22, which is utilized for discharging air to blow the bag onto the receiving station or conveyor and to cause the bag to lay out generally flat for ultimate pick-up. This system generally includes a plurality of nozzles 24—24 which are disposed above the plane of the product and converge downwardly toward the plane of the film product and tend to discharge air against the product. In order to provide a continuous flow of compressed gaseous fluid to nozzles 24—24, a feed line or tube is provided as at 23.

As has been indicated, the radially extending arms such as arms 31—31 and 32—32 of rotary stacker 12 are desired for receiving the product from grid 21 and ultimately delivering the product onto spaced receiving pins 50 of wicketing device 14 at the opposed side of the stacker. When these stacking machines are being operated at high speeds, the problems resulting from the tendency of one film member to "follow" its preceding member from the receiving station upwardly toward the retreating arms, may be reduced by the generation of reduced pressure due to the Bernoulli effect on the underside of the product receiving pad. The disruption of the Bernoulli effect by air turbulence from solid extension members may be reduced by the use of grid-like members.

Also, as is apparant, rotating stacker 12 is provided with a drive arrangement which rotates the core at a speed sychronized with the operation of bag-making machine 11. Thus, the arrangement is such that upon occurrence of a film bag being received on base pad 21, radial arms 31—31 and 32—32 and extension members 30—30 engage the bag along its body but adjacent its end and move it through 180 degrees of arc for transfer onto receiving pins 50. Such operation is generally consistent with apparatus which is (in part) commercially available and/or is generally illustrated and described in U.S. Pat. No. 3,921,827.

We claim:

1. In a stacking machine for sequentially transporting plastic film workpieces to a product receiving station:

(a) a pair of arms extending radially from an axis in a common plane and spaced along said axis to jointly define a quadrilateral working surface;

(b) means for causing unitary rotation of said arms about said axis to rotate said working surface;

(c) means for releasably securing ends of a workpiece to said arms for rotation therewith, to result in turbulence of the air ambient thereto;

(d) and extension means secured to at least one of said arms to extend said working surface in the direction of said axis away from the other arm, so as to reduce the air turbulence resulting from said rotation.

2. A machine according to claim 1 in which said extension means are secured to both of said arms.

3. A machine according to claim 1 including a plurality of pairs of said arms, extending from said axis in angularly spaced directions, and extension means secured to at least one of the arms of each pair.

4. A machine according to claim 3 in which said extension means are secured to both of the arms of each pair.

5. A machine according to claim 1 in which said extension means includes a plurality of spaced, substantially coplanar linear members extending away from said one arm in a direction generally parallel to said axis.

6. Means for reducing turbulence, in a stacking machine for plastic film workpieces in which the pieces are transported sequentially by radial arms rotated jointly about an axis and releasably secured to the ends of said pieces, said means comprising extension means secured to at least one of said arms and extending therefrom in the direction of said axis away from the other arm.

* * * * *